US007517034B2

(12) United States Patent
Jung

(10) Patent No.: US 7,517,034 B2
(45) Date of Patent: Apr. 14, 2009

(54) INK EJECTION DEVICE, IMAGE FORMING APPARATUS HAVING THE SAME AND METHOD THEREOF WITH GAP CONTROL OF PRINTHEAD AND PRINT MEDIUM

(75) Inventor: Youn-gun Jung, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 318 days.

(21) Appl. No.: 11/294,499

(22) Filed: Dec. 6, 2005

(65) Prior Publication Data

US 2006/0268026 A1 Nov. 30, 2006

(30) Foreign Application Priority Data

May 30, 2005 (KR) ..... 10-2005-0045434

(51) Int. Cl.
*B41J 25/308* (2006.01)
*B41J 29/38* (2006.01)
*B41J 29/393* (2006.01)

(52) U.S. Cl. ..... 347/8; 347/5; 347/19

(58) Field of Classification Search ..... 347/8, 347/74, 78, 104, 37, 55, 47, 82, 19, 5, 14, 347/16, 101; 400/59; 216/27
See application file for complete search history.

(56) References Cited

U.S. PATENT DOCUMENTS 4,459,600 A * 7/1984 Sato et al. ..... 347/47
5,811,019 A * 9/1998 Nakayama et al. ..... 216/27
5,854,643 A * 12/1998 Katsuyama ..... 347/8
5,956,054 A * 9/1999 Hirabayashi et al. ..... 347/37
5,992,968 A * 11/1999 Uetsuki et al. ..... 347/37
6,083,411 A * 7/2000 Nakayama et al. ..... 216/27
6,309,050 B1 * 10/2001 Ikeda et al. ..... 347/55
6,382,771 B1 5/2002 Ikeda et al.
6,604,801 B2 * 8/2003 Park ..... 347/8
6,736,557 B2 * 5/2004 DeVore et al. ..... 400/59
6,860,588 B1 * 3/2005 Holstun et al. ..... 347/47
7,052,100 B2 * 5/2006 Otsuki ..... 347/16

(Continued)

FOREIGN PATENT DOCUMENTS

EP 1 428 665 6/2004

(Continued)

OTHER PUBLICATIONS

Korean Office Action dated Jul. 31, 2006 of Korean Patent Application No. 10-2005-0045434.

(Continued)

*Primary Examiner*—Manish S Shah
*Assistant Examiner*—Rene Garcia, Jr.
(74) *Attorney, Agent, or Firm*—Stanzione & Kim, LLP

(57) ABSTRACT

An ink ejection device, an image forming apparatus having the same, and a method thereof. The ink ejection device includes a print head including at least one head chip in which a plurality of nozzles is arranged to eject ink on a printing medium at a predetermined angle inclined with respect to a printing line extending along a widthwise direction of the printing medium, and a gap controlling unit to control a gap size between the printing medium and the plurality of nozzles.

18 Claims, 8 Drawing Sheets

U.S. PATENT DOCUMENTS

2006/0197811 A1* 9/2006 Kuwahara et al. ..... 347/82

FOREIGN PATENT DOCUMENTS

| | | |
|---|---|---|
| JP | 57-129755 | 8/1982 |
| JP | 61-78659 | 4/1986 |
| JP | 12-22983 | 9/1989 |
| JP | 81-8593 | 4/1996 |
| JP | 10-217444 | 8/1998 |
| JP | 2000-211117 | 8/2000 |
| JP | 2002-187260 | 7/2002 |
| JP | 2003-072055 | 3/2003 |
| JP | 2003-276273 | 9/2003 |
| JP | 2004-188956 | 7/2004 |
| JP | 2004-358826 | 12/2004 |
| JP | 2004358826 A * | 12/2004 |

OTHER PUBLICATIONS

Chinese Office Action dated Jun. 6, 2008 issued in CN 2006-10084264.5.

European Search Report dated Jun. 5, 2008 issued in EP 06114598.3.

* cited by examiner

INK EJECTION DEVICE, IMAGE FORMING APPARATUS HAVING THE SAME AND METHOD THEREOF WITH GAP CONTROL OF PRINTHEAD AND PRINT MEDIUM

CROSS-REFERENCE TO RELATED APPLICATIONS

This application claims the benefit of Korean Patent Application No. 2005-45434 filed on May 30, 2005, in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to an ink ejection device usable with a page printing type image forming apparatus, an image forming apparatus using the same, and a method thereof.

2. Description of the Related Art

An ink-jet type image forming apparatus ejects ink drops on a printing medium (e.g., paper) to form an image on the printing medium. The ink-jet type image forming apparatus may be classified as a line printing type and a page printing type (i.e., a wide array type inkjet head). The line printing type image forming apparatus includes a print head that ejects ink drops and reciprocates back and forth along a widthwise direction of the printing medium to form the image. The page printing type image forming apparatus also includes a print head, and a plurality of nozzles is arranged in the print head as long as a width of the printing medium. The page printing type image forming apparatus forms images in a line of the printing medium at once while the printing medium is being conveyed. In other words, the page printing type image forming apparatus can form an entire line of the image at one time.

A printing resolution of the line printing type image forming apparatus can be controlled by controlling a conveying speed of the printing medium. That is, it is possible that the line printing type image forming apparatus forms images with a higher printing resolution by reducing the conveying speed of the printing medium. If the conveying speed of the printing medium is reduced, images are formed even on a printing area on the printing medium between nozzles. As a result, the images can be formed with the higher printing resolution. However, it is difficult to control a printing resolution of the page printing type image forming apparatus by controlling a conveying speed of the printing medium, since the print head is typically fixed in the page printing type image forming apparatus and is not movable therein. Therefore, it is difficult to form images on the printing area on the printing medium between the nozzles using the page printing type image forming apparatus.

As described above, it is difficult to form images with higher printing resolution using the page printing type image forming apparatus, since the printing resolution is limited by a nozzle printing resolution that is defined by nozzles (i.e., a nozzle arrangement) of the print head. Therefore, research has been performed in an effort to improve the nozzle printing resolution by arranging a number of nozzles in a unit area of a head chip. However, arranging and/or increasing the number of nozzles in the unit area of the head chip typically decreases a yield of the head chip.

Furthermore, a heater for ejecting the ink may be easily deteriorated or an ink-ejection path may be blocked because the head chip may be inferior or may be used for a long-time use. As a result, some of nozzles may malfunction. The malfunctioning nozzles cannot eject ink drops. Thus, the nozzles that malfunction form a white line on the image printed on the printing medium, since no image is formed by the malfunctioning nozzles.

SUMMARY OF THE INVENTION

Accordingly, the present general inventive concept provides an ink ejection device to form an image with a higher printing resolution than a printing resolution defined by nozzles of a print head (i.e., a nozzle printing resolution), an image forming apparatus having the same, and a method thereof.

The present general inventive concept also provides an ink ejection device to correct for a malfunctioning nozzle, an image forming apparatus, and a method thereof.

Additional aspects of the present general inventive concept will be set forth in part in the description which follows and, in part, will be obvious from the description, or may be learned by practice of the general inventive concept.

The foregoing and/or other aspects of the present general inventive concept are achieved by providing an ink ejection device including a print head including at least one head chip in which a plurality of nozzles is arranged to eject ink on a printing medium at a predetermined angle inclined with respect to a printing line extending along a widthwise direction of the printing medium, and a gap controlling unit to control a gap size between the printing medium and the plurality of nozzles.

The foregoing and/or other aspects of the present general inventive concept are also achieved by providing an image forming apparatus including a print head having at least one head chip in which a plurality of nozzles is arranged at a predetermined angle inclined with respect to a printing line L extending along a widthwise direction of a printing medium, a conveying unit to convey the printing medium to a location where the print head forms an image on the printing medium, a gap controlling unit to control a gap size between the printing medium and the plurality of nozzles, and a controller to control the gap controlling unit to control the gap size, and to control the print head to eject ink.

The gap controlling unit may include a cam member to change a location of the print head, and a drive motor to drive the cam member. Alternatively, the gap controlling unit may include a cam member to change a location of a medium supporting member which is arranged under the print head to support the printing medium, and a drive motor to drive the cam member. Additionally, an ink ejection passage of the plurality of nozzles may be inclined with respect to the printing line of the printing medium at the predetermined angle.

The controller may determine a number of first gap controlling times N1 according to a target printing resolution, may determine a first gap size G1 according to the determined number of first gap controlling times N1, and may control the first gap size G1 that corresponds to each of the first gap controlling times N1 by controlling the gap controlling unit. The controller may determine a number of second gap controlling times N2 to correct for a malfunctioning nozzle when one of nozzles malfunctions, may determine a second gap size G2 that corresponds to the determined number of second gap controlling times N2, and may control the gap controlling unit to control the second gap size G2 that corresponds to each of the second gap controlling times N2. The conveying unit may include a feed roller being rotated while contacting the printing medium, and a first drive motor to drive the feed roller.

The at least one head chip may be mounted in the print head at the predetermined angle inclined along the printing line of the printing medium.

The print head may be disposed at the predetermined angle inclined along the printing line of the printing medium.

The conveying unit may include a convey belt rotating in a manner to have an endless track, and a first drive motor to drive the convey belt, and the controller rotates the convey belt to convey the printing medium to a location where the print head forms an image according to a number of gap controlling times N by controlling the first drive motor.

The foregoing and/or other aspects of the present general inventive concept are also achieved by providing an image forming apparatus, comprising a support part to support a printing medium, an inkjet head having a plurality of nozzles to define a nozzle resolution and being disposed above the support part a predetermined distance therefrom to eject ink onto the printing medium at a non-vertical angle, and a controller to adjust the predetermined distance according to a target printing resolution.

The foregoing and/or other aspects of the present general inventive concept are also achieved by providing an ink ejection device, comprising an inkjet head to eject ink from a plurality of nozzles at a non-vertical angle to a plurality of points on a printing medium, and the inkjet head is vertically movable such that one or more points that correspond to one or more malfunctioning nozzles are printable to by one or more functioning nozzles when the inkjet head is vertically moved.

The foregoing and/or other aspects of the present general inventive concept are also achieved by providing an image forming apparatus, comprising a support part to support a printing medium, an inkjet head having a plurality of nozzles to eject ink to the printing medium at a non-vertical angle, and a controller to control one or more drive motors to adjust a displacement between the support part and the inkjet head such that a number of points on the printing medium that are printable to by the inkjet head is increased.

The foregoing and/or other aspects of the present general inventive concept are also achieved by providing an inkjet head, comprising a plurality of nozzles to eject ink to a printing medium at a non-vertical angle.

The foregoing and/or other aspects of the present general inventive concept are also achieved by providing a method of forming an image usable in an image forming apparatus having a print head in which a plurality of nozzles is included to eject ink at a predetermined inclined from a printing line extending along a widthwise direction of the printing medium, the method including determining a number of gap controlling times N to control a gap size between the plurality of nozzles and the printing medium, and determining a gap size G for each of the gap controlling times N, and ejecting ink a number of times that is equal to the number of gap controlling times N while controlling the gap size G that corresponds to the number of gap controlling times at each corresponding printing period.

The foregoing and/or other aspects of the present general inventive concept are also achieved by providing a method of controlling an image forming apparatus having a support part to support a printing medium and an inkjet head having a plurality of nozzles to define a nozzle resolution and being disposed above the support part a predetermined distance therefrom to eject ink onto the printing medium at a non-vertical angle, the method comprising adjusting the predetermined distance between the support part and the inkjet head according to a target printing resolution.

The foregoing and/or other aspects of the present general inventive concept are also achieved by providing a method of controlling an image forming apparatus having an inkjet head to eject ink from a plurality of nozzles at a non-vertical angle to a plurality of points on a printing medium, the method comprising controlling the inkjet head to vertically move such that one or more points that correspond to one or more malfunctioning nozzles in the inkjet head are printable to by one or more functioning nozzles.

The foregoing and/or other aspects of the present general inventive concept are also achieved by providing a method of controlling an image forming apparatus having a support part to support a printing medium and an inkjet head having a plurality of nozzles to eject ink to the print medium at a non-vertical angle, the method comprising controlling one or more drive motors to adjust a displacement between the support part and the inkjet head such that a number of points on the printing medium that are printable to by the inkjet head is increased.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
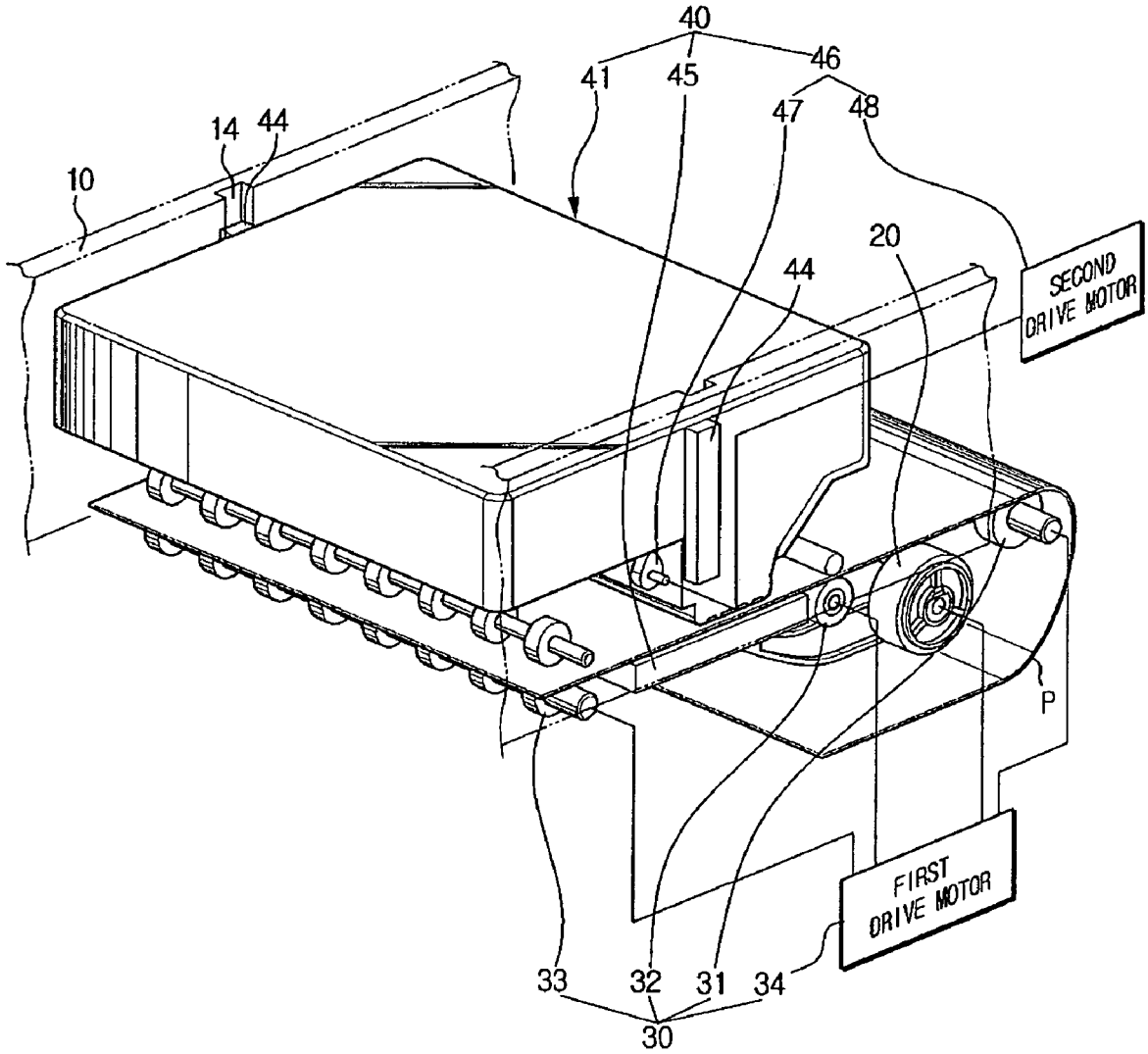
FIG. 1 is a perspective view illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIGS. 1 through 5 illustrate an image forming apparatus according to an embodiment of the present general inventive concept.

Referring to FIGS. 1 through 5, the image forming apparatus includes a main body 10, a pickup roller 20 rotatably mounted at the main body 10 to pick up a printing medium P from a feeding cassette, a conveying unit 30 rotatably supported by the main body 10 to convey the printing medium P picked up by the pickup roller 20, an ink ejection device 40 to eject ink drops on the conveyed printing medium P according to printing data to form a predetermined image on the printing medium P, and a controller 50 to control the conveying unit 30 and the ink ejection device 40.

The conveying unit 30 includes a drive roller 31 to guide the printing medium P to a print head 41, a feed roller 32 to convey the guided printing medium P to a bottom of the print head 41, and an eject roller 33 to eject the printing medium P after completely forming the image thereon. The pickup roller 20, the drive roller 31, the feed roller 32 and the eject roller 33 are connected to a power transferring unit (not shown) such as a first drive motor 34 or a gear train to receive power therefrom. The first drive motor 34 is connected to the controller 50 to exchange signals therewith.

The ink ejection device 40 includes the print head 41 movably disposed in the main body 10 in an upward direction and a downward direction, a supporting member 45 disposed under the print head 41 to support the conveyed printing medium P, and a gap control unit 46 to control a gap size G between the print head 41 and the printing medium P The gap size G represents a distance between the print head 41 and the printing medium P. The print head 41 may be a wide-array type inkjet head that is capable of forming an entire line of an image at one time.

Figure 4:
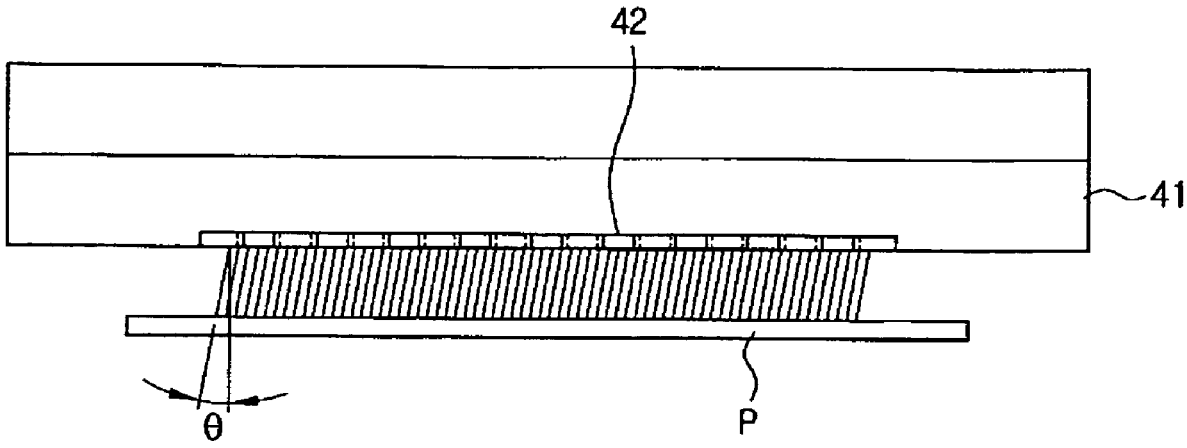
FIG. 4 is a front view illustrating a head chip in the image forming apparatus of FIG. 1.
Figure 5:
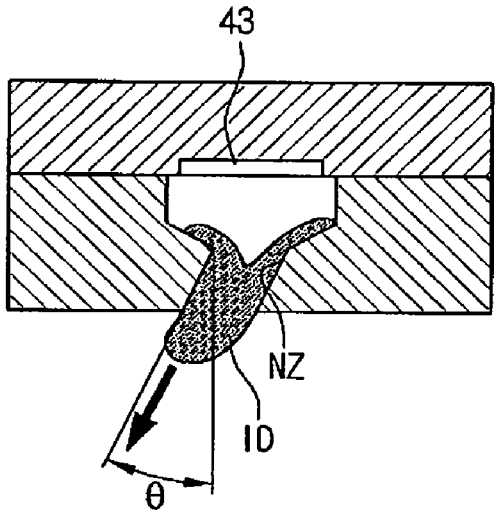
FIG. 5 is a cross-sectional view illustrating a nozzle of the head chip of FIG. 4.
Figure 6:
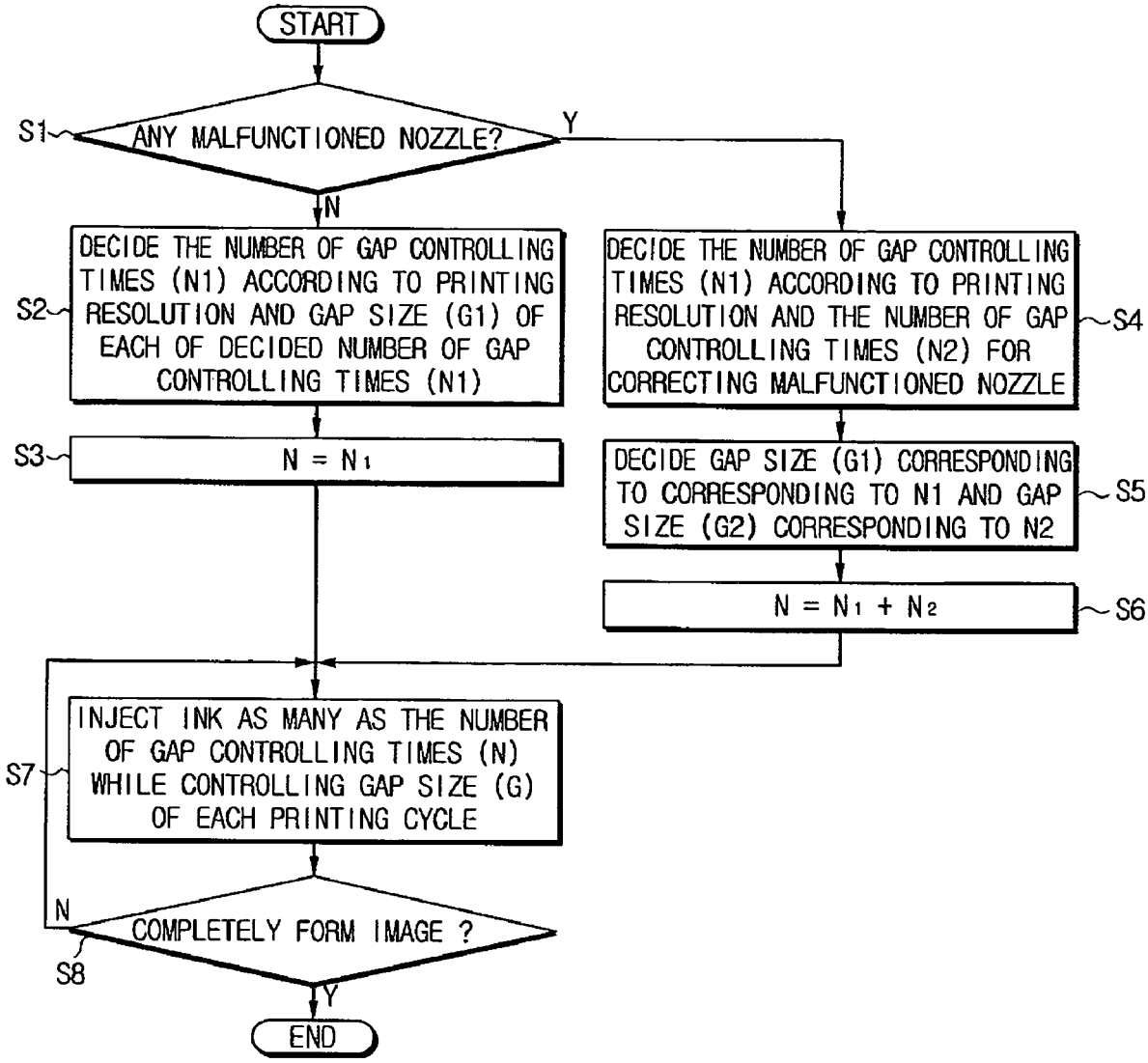
FIG. 6 is a flowchart of a method of forming an image according to an embodiment of the present general inventive concept.

The print head 41 may contain four colors of inks, i.e., yellow, magenta, cyan black, and may include four corresponding lines of head chips 42 to independently eject each color of ink. The four lines of head chips 42 are disposed at one side of the print head 41 facing the printing medium P. As illustrated in FIG. 5, each of the head chips 42 includes a heater 43 to heat the ink stored therein to eject the ink, and nozzles NZ to eject the heated ink through an ink ejection passage. The nozzles NZ may be arranged in a direction that is orthogonal to a conveying direction of the printing medium P or may be inclined in a widthwise direction of the printing medium P at a predetermined angle (θ) as illustrated in FIGS. 4 and 5. Thus, the nozzles NZ eject the ink on the printing medium P at the predetermined angle (θ) inclined along the widthwise direction of the printing medium P.

Both sides of the print head 41 may include a guide protrusion 44. The guide protrusion 44 is inserted into a guide groove 14 to upwardly and downwardly guide the print head 41.

The gap control unit 46 includes a cam member 47 and the first drive motor 34 to drive the cam member 47. The cam member 47 is rotatably disposed in the main body 10 to support the print head 41. The cam member 47 is connected to the first drive motor 34 by the power transferring unit (not shown) such that power is transferred thereto. The first drive motor 34 is connected to the controller 50 to exchange signals therewith, and the first drive motor 34 is driven by a signal transferred from the controller 50. Accordingly, if the controller 50 drives the first drive motor 34, a driving force of the first drive motor 34 is transferred to the cam member 47 through the power transferring unit to rotate the cam member 47. The rotating cam member 47 moves the print head 41 upward and/or downward. As a result, the rotating cam member 47 changes the gap size G between the print head 41 and the printing medium P. More specifically, the gap size G between the nozzles NZ and the printing medium P is varied by the rotating cam member 47. If the gap size G varies, a hit point HP of an ink drop on the printing medium P also changes, because the nozzles NZ eject the ink drops on the printing medium P at the predetermined angle (θ) inclined along the widthwise direction of the printing medium P. That is, an ink ejection direction of the ink droplets through the nozzles NZ is inclined with respect to a line perpendicular to a major plane of the printing medium P Also, a wall defining each nozzle NZ and having a central axis is parallel to the ink ejection direction and is inclined with respect to the line perpendicular to the printing medium P. Therefore, distances between hit points HP formed on the printing medium P can be made more narrow than distances between the nozzles NZ by controlling the gap size G. That is, the image forming apparatus according to the present embodiment can form images with a higher printing resolution than a printing resolution defined by the nozzles NZ of the print head 41 (i.e., a nozzle printing resolution) by controlling the gap size G. In the present embodiment, the gap size G is controlled using the cam member 47. However, the present general inventive concept is not limited to using the cam member 47. The gap size G may be controlled by various methods such as a method of moving the supporting member 45, or a method of moving both of the supporting member 45 and the print head 41.

Figure 3:
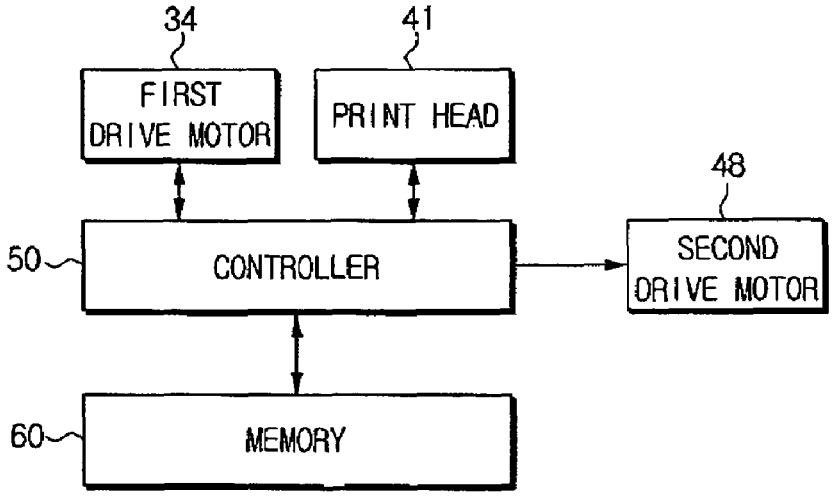
FIG. 3 is a block diagram illustrating the image forming apparatus of FIG. 1.

As illustrated in FIGS. 1 and 3, the controller 50 controls the first drive motor 34 to convey the printing medium P and also controls a second drive motor 48 to control the gap size G between the print head 41 and the printing medium P. Furthermore, the controller 50 transfers the printing data from a host, i.e., a computer, to the print head 41 to form an image according to the printing data.

Referring to FIG. 3, a memory 60 stores control programs to drive the controller 50. In particular, the memory 60 stores correlations between printing resolutions and the corresponding gap sizes G. The gap sizes G between the print head 41 and the printing medium P may be stored as a look-up table to correct image distortion caused by the malfunctioning nozzle NZ.

Hereinafter, operations of the image forming apparatus of the embodiments of FIGS. 1 to 5 will be described with reference to FIGS. 6 through 8B.

At first, a user inputs a target printing resolution to the image forming apparatus through a user interface of the host. The printing data including the input target printing resolution is then transmitted from the host to the controller 50 of the image forming apparatus. The controller 50 determines whether there is a malfunctioning nozzle NZ in operation S1. For example, the controller 50 may sense a temperature of each head chip 42 in the print head 41 to find the malfunctioning nozzle NZ.

If there is no malfunctioning nozzle NZ, the controller 50 determines a number of first gap controlling times N1 that corresponds to the input target printing resolution, and determines a first gap size G1 for each of the first gap controlling times in operation S2. In the present embodiment, the controller 50 determines a number of total gap controlling times N as the number of first gap controlling times N1 in operation S3, since there are no malfunctioning nozzles NZ.

Figure 7A:
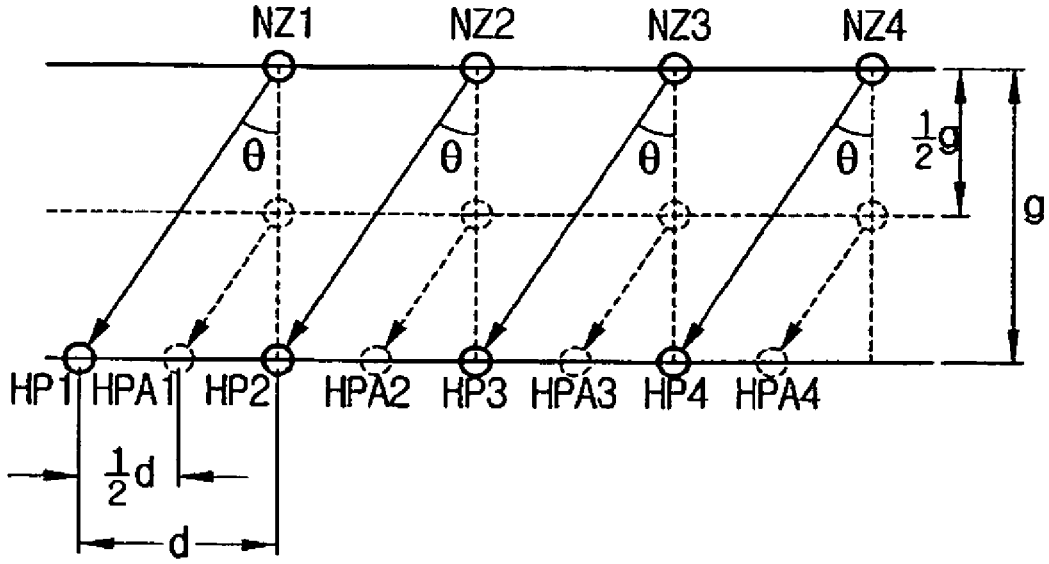
FIG. 7A is a conceptual view illustrating a gap control operation for a target resolution according to an embodiment of the present general inventive concept.

FIG. 7A illustrates locations of the nozzles NZ and the hit points HP when images are formed with a target printing resolution which is two times greater than a printing resolution defined by the nozzles NZ (i.e., the nozzle resolution). As illustrated in FIG. 7A, NZ1 to NZ4 along a solid line represent locations of the nozzles NZ1 to NZ4 before controlling the first gap size G1. In FIG. 7A "g" represents a gap size "g" (i.e. a full gap size) before controlling the first gap size G1, and "HP" represents the hit point of an ink drop on the printing medium P before controlling the first gap size G1. Since each of the nozzles NZ ejects the ink drops the predetermined angle (θ), distances "d" between the hit points HP1, HP2, HP3 and HP4 are identical. The controller 50 controls the nozzles NZ1 to NZ4 to eject the ink drops at one time when the nozzles NZ1 to NZ4 are arranged on the solid line as illustrated in FIG. 7A. The controller 50 then drives the second drive motor 48 to move the print head 41 in a downward direction to reduce the first gap size G1 by one half. That is, the first gap size G1 is reduced from "g" to "0.5g." In FIG. 7A, dotted lines represent locations of the nozzles NZ and the hit points HP after reducing the first gap size G1 by the half (i.e., "0.5g"). After reducing the first gap size G1 the controller 50 controls the nozzles NZ1 to NZ4 to eject the ink drops to form hit points HPA1 to HPA4 on the printing medium P. "HPA" represents a hit point formed after reducing the first gap size G1 by the half. As a result, the hit points HPA1 to HPA4 (i.e., current hit points) are formed between the previously formed hit points HP1 to HP4, respectively. For example, the hit point HPA1 is formed at a midpoint between the hit point HP1 and the hit point HP2. Therefore, a distance between currently formed hit points HPA1 to HPA4 and previously formed hit points HP1 to HP4 decreases from "d" to "0.5d," after reducing the first gap size G1. That is, the printing resolution of the image becomes two times greater than the nozzle printing resolution, when the first gap size G is controlled in the manner described above. As described above, the printing resolution can be controlled using the method of forming an image according to the present embodiment. That is, if the first gap size G1 is controlled three times, a printing resolution that is three times greater than the nozzle printing resolution can be obtained. In this case, the corresponding first gap sizes G1 are controlled to be "g", "2g/3," and "g/3."

Referring to FIG. 7A, a first nozzle NZ1 is used to form the hit point HPA1 between the previously formed hit points HP1 and HP2, which are formed by the first nozzle NZ1 and a second nozzle NZ2, respectively. However, other nozzles NZ2 or NZ3 can alternatively be used to eject ink drops to the hit point HPA1 instead of using the first nozzle NZ1. For example, if the second nozzle NZ2 is used to eject ink drops to the hit point HPA1 to form an image with a printing resolution that is two times greater than the nozzle printing resolution, the number of first gap controlling times N1 is two and the first gap sizes G1 are controlled to be "g" and "1.5g" in the corresponding first gap controlling times N1. When the second nozzle NZ2 is used to eject ink drops to form an image with a printing resolution that is three times greater than the nozzle printing resolution, the number of first gap controlling times N1 is three and the first gap sizes G1 are controlled to be "g," "4g/3," and "5g/3" in the corresponding first gap controlling times N1. The number of first gap controlling times N1 and the first gap sizes G1 can be calculated by the following equation.

$$G1=(n-p)\times g \qquad \text{Equation 1}$$

In Equation 1, G1 represents the first gap size, and "n" represents an identification number of a nozzle to eject ink drops on the hit point HPA1 between the hit point HP1 and the hit point HP2 which are previously formed by the first nozzle NZ1 and the second nozzle NZ2, respectively. For example, if n=1, the first nozzle NZ1 ejects the ink drops on the hit point HPA1, and if n=2, the second nozzle NZ2 ejects the ink drops on the hit point HPA1. Furthermore, if n=3, a third nozzle NZ3 is used to eject the ink drops on the hit point HPA1.

In Equation 1, "p" represents a number of hit points HPA1 formed between the previously formed hit points HP1 and HP2. The value of p is between 0 and 1. That is, "p" is variable representing a scale factor "r" between the printing resolution of the formed image (i.e., the target printing resolution) and the nozzle printing resolution. For example, if the target printing resolution is two times greater than the nozzle printing resolution, p=0, and 1/2, and the number of the hit points (HPA1) in between the hit points HP1 and HP2 is 1. If the printing resolution of the formed image is three times greater than the nozzle printing resolution, p=0, 1/3, 2/3, and the number of hit points (HPA1) in between the hit points HP1 and HP2 is 2. In other words, the number of hit points (HPA1) between each of the previously formed hit points HP1 to HP4 is also 2. Also, if the printing resolution of the formed image is four times greater than the nozzle printing resolution, p=0, 1/4, 2/4, and 3/4 and the number of the hit points (HPA1) is 4. That is, the variable "p" is calculated by the following Equation.

$$p=0,1/r,2/r,\ldots,(r-1)/r \qquad \text{Equation 2}$$

In Equation 2, "r" represents the number of hit points HPA1 between the hit point HP1 and the hit point HP2. That is, "r" also represents the number of times N1 of controlling the first gap size G1.

If one of the nozzles NZ malfunctions, the controller 50 determines the number of first gap controlling times N1 according to the input target printing resolution and a number of second gap controlling times N2 according to the malfunctioning nozzle NZ in order to correct image distortion caused by the malfunctioning nozzle NZ in operation S4. Then, the controller 50 determines the first gap size G1 corresponding to the number of first gap controlling times N1 and determines a second gap size G2 corresponding to the number of second gap controlling times N2 in operation S5. As a result, the total gap controlling times N is a sum of N1 and N2, wherein N1 represents the number of first gap controlling times according to the target printing resolution assuming the nozzles NZ are working properly, and N2 represents the number of second gap controlling times according to the malfunctioning nozzle NZ. N1 and G1 are determined, as described above in the operations S1, S2, and S3. However, N2 should be equal to the number of malfunctioning nozzles NZ, and G2 should be controlled to eject ink drops on the hit points HP, where an image can not be formed by the malfunctioning nozzles.

Figure 7B:
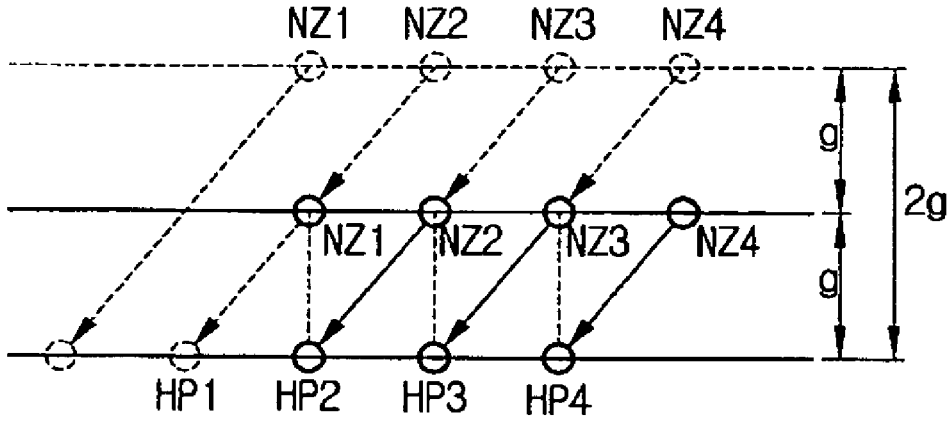
FIG. 7B is a conceptual view illustrating a gap control operation for a malfunctioning nozzle according to an embodiment of the present general inventive concept.

FIG. 7B illustrates formation of an image using a second nozzle NZ2 that is adjacent to a malfunctioning first nozzle NZ1.

Referring to FIG. 7B, if nozzles NZ1 to NZ4 on the solid line eject ink drops when the first nozzle NZ1 malfunctions, an image is not formed on a hit point HP1 of the first nozzle NZ1. In this case, the controller 50 drives the first drive motor 34 to increase the second gap size G2 by as much as "g." That is, the second gap size G2 is changed to "2g." After increasing the second gap size G2, the controller 50 controls the nozzles NZ1 through NZ4 arranged along the dotted line to eject ink drops. As a result, the second nozzle NZ2 forms an image on the hit point HP1. FIG. 7B illustrates formation of the image when the first nozzle NZ1 malfunctions. However, the method of forming images according to the present embodiment can correct a distorted image when one of the other nozzles NZ2 to NZ4 malfunctions, or when more than one of other nozzles NZ2 to NZ4 malfunction. Additionally, it should be understood that the print head 41 may have more than four nozzles in a variety of different arrangements including, for example, a two dimensional array of nozzles of one or more colored inks. The second gap size G2 can be defined by the following Equation.

$$G2=ng \qquad \text{Equation 3}$$

In Equation 3, "n" represents an integer greater than or equal to 2. When n=2, the image distortion caused by the malfunction of the first nozzle NZ1 is corrected by the second nozzle NZ2. That is, the nozzle adjacent to the malfunctioning nozzle NZ can correct the distorted image. When n=3, the image distortion caused by the malfunction of the first nozzle NZ1 is corrected by the third nozzle NZ3. That is, one of the nozzles that is adjacent to or n nozzles away from the malfunctioning nozzle NZ can correct the distorted image. Accordingly, the image distortion is corrected by a nozzle that is farther from the malfunctioning nozzle NZ as n increases.

The number of second gap controlling times N2 according to the malfunctioning nozzle NZ is determined according to the number of malfunctioning nozzles NZ and the value of "n." For example, if both the first nozzle NZ1 and the second nozzle NZ2 malfunction and "n" is 2, the number of second gap controlling times N2 according to the malfunctioning nozzle NZ is determined to be 3. The second gap sizes G2 for the determined N2 are controlled to be "g," "2g," and "3g" for respective second gap controlling time NZ. Furthermore, if "n" is 3, the number of second gap controlling times N2 according to the malfunctioning nozzle NZ is determined to be 2 and the second gap sizes G2 for the determined N2 are controlled to be "g" and "3g." When n=3 and G2 is "g," the image distortion caused by the malfunction of the first nozzle NZ1 and the malfunction of the second nozzle NZ2 is corrected by a third nozzle NZ3 and a fourth nozzle NZ4, respectively. Therefore, the number of total gap controlling times N corresponding to a maximum gap size may be set when the maximum gap size is set. As described above, the number of total gap controlling times N is determined by the sum of N1 and N2 when one of the nozzles NZ malfunctions. However, if there are no malfunctioning nozzles, the number of total gap controlling times N is determined to be equal to the number of first gap controlling times N1 according to the target printing resolution.

As described above, the image distortion may be corrected by using one of the nozzles NZ that is adjacent to a location of a malfunctioning nozzle NZ to print to a hit point HP that corresponds to the malfunctioning nozzle NZ. However, the image distortion may be corrected by using a simple equation to choose another nozzle NZ to print to the hit point HP of the malfunctioning nozzle NZ. Also, another nozzle NZ that is adjacent to but further away from the malfunctioning nozzle NZ, may be selected by a simple equation to correct the image distortion. That is, although distances between the nozzles NZ and an ejection direction may be differently designed, the method of forming an image according to the present embodiment can be applied in the same manner to correct the image distortion with simple equations, regardless of the direction in which ink is ejected from the nozzles NZ and regardless of an arrangement of the nozzles NZ. That is, the method of determining the number of times of controlling the gap size N and the gap size G is applied in the same manner to print heads having different angles of ink ejection and different nozzle arrangements.

Figure 2:
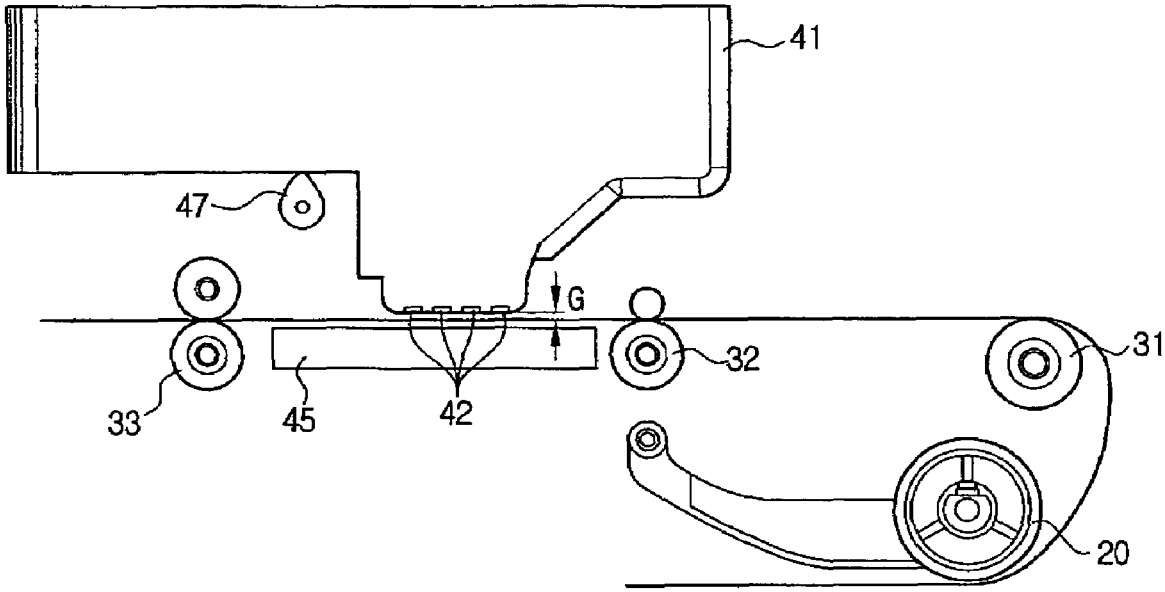
FIG. 2 is a side view illustrating the image forming apparatus of FIG. 1.

After determining the gap size G, the ink drops are ejected on printing lines or at printing periods that correspond to the number of total gap controlling times N in operation S7. The image forming apparatus of various embodiment of the present general inventive concept. FIG. 2 may eject the ink drops according to the following three methods. In a first image forming method, the image forming apparatus ejects the ink drops on the printing medium P that is constantly conveyed according to a number of printing periods that correspond to number of total gap controlling times N while maintaining the gap size G that corresponds to each of the number of total gap controlling times N. In a second image forming method, the image forming apparatus controls the second drive motor 48 illustrated in FIGS. 1 and 3 to stop the conveying of the printing medium P at each of the printing periods that correspond to the number of total gap controlling times N or at each printing line, and forms images while maintaining the gap size G for each of the number of total gap controlling times N. In a third image forming method, the image forming apparatus ejects ink drops by driving the second drive motor 48 in forward and backward directions for each of the number of total gap controlling times N while controlling the gap size G.

Figure 8A:
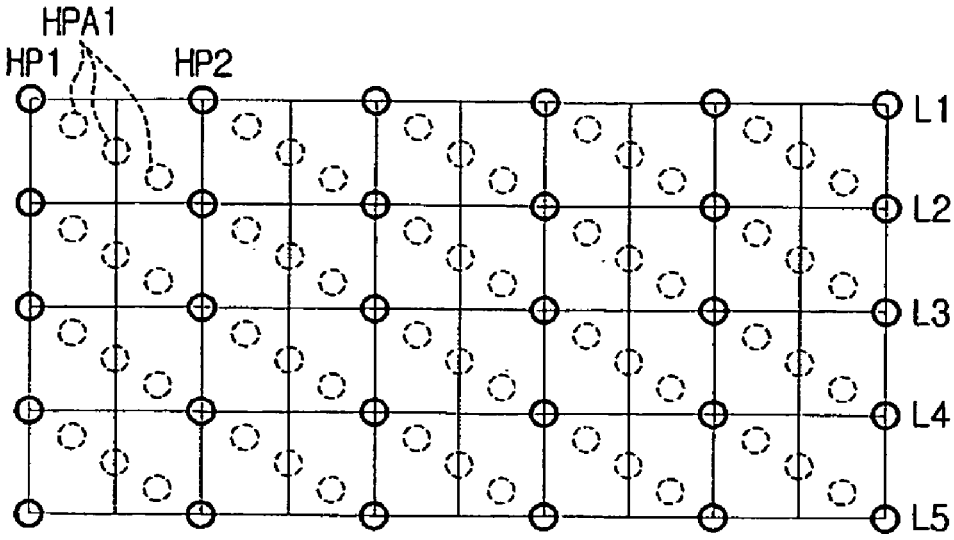
FIG. 8A is a schematic view illustrating a location of an image formed on a printing medium which is conveyed at a constant speed according to an embodiment of the present general inventive concept.

FIG. 8A illustrates images formed by the first method of forming an image. As illustrated in FIG. 8A, three hit points HPA are formed in a diagonal direction between a first printing line L1 and a second printing line L2 during one printing period. These three hit points HPA are formed between hit points HP1 and HP2, and a distance between the hit point HP1 and the hit point HP2 corresponds to a distance "d" between the nozzles NZ. Therefore, the number of total gap controlling times N is 4 and the corresponding gap sizes G are controlled to be "g," "g/4," "g/2," and "3g/4." When the image is formed by controlling the gap size G four times while the printing medium P is being conveyed at a constant speed, the hit points HPA are formed in a diagonal direction. Since each of the hit points HPA is very small, the individual hit points HPA cannot be identified by a user. Instead, the image that is formed is perceived as having a higher printing resolution.

Figure 8B:
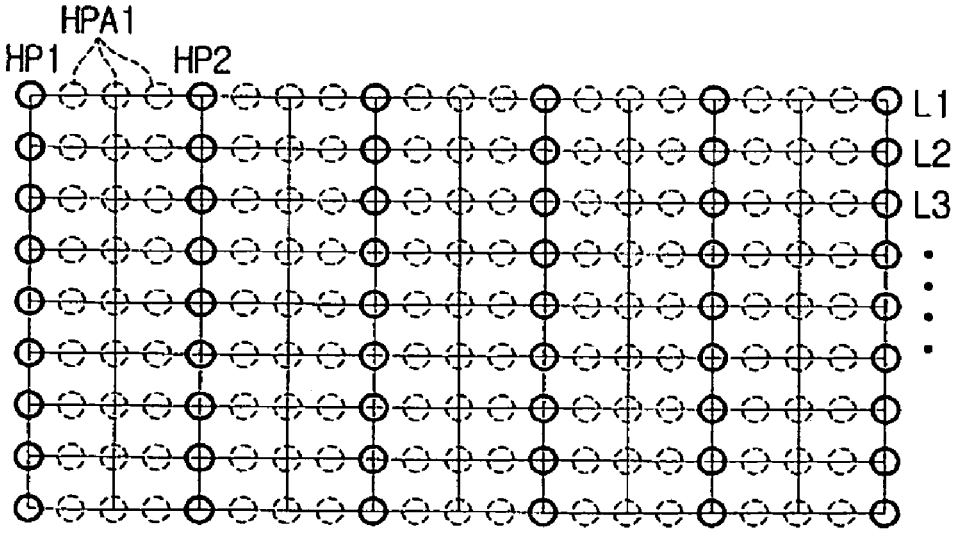
FIG. 8B is a schematic view illustrating a location of an image formed on a printing medium which is conveyed in a reverse direction according to an embodiment of the present general inventive concept.

FIG. 8B illustrates hit points formed by the second and third image forming methods. The hit points HPA (i.e., HPA1, etc.) and HP (i.e., HP1, HP2, etc.) are formed on single printing line L1, L2, . . . Ln together.

Figure 9:
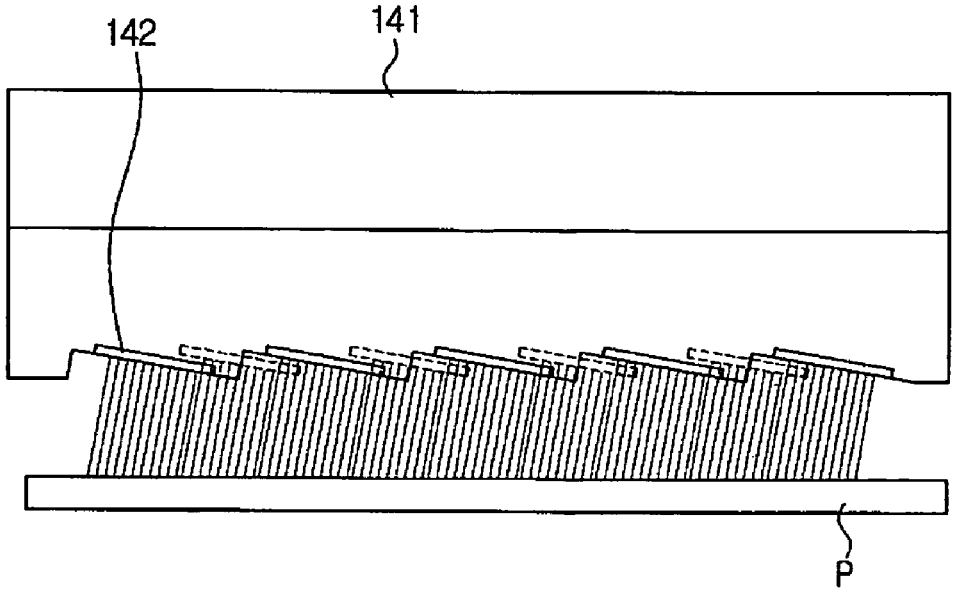
FIG. 9 is a front view illustrating an ink ejection device according to another embodiment of the present general inventive concept.

FIG. 9 illustrates an ink ejection device according to another embodiment of the present general inventive concept. As illustrated in FIG. 9, head chips 142 are mounted at a print head 141 at a predetermined angle inclined in a widthwise direction (i.e., along a printing line direction) of a printing medium P in the ink ejection device. Therefore, the ink ejection device according to the present embodiment ejects ink drops on the printing medium P at a predetermined angle inclined in the printing line direction.

Figure 10:
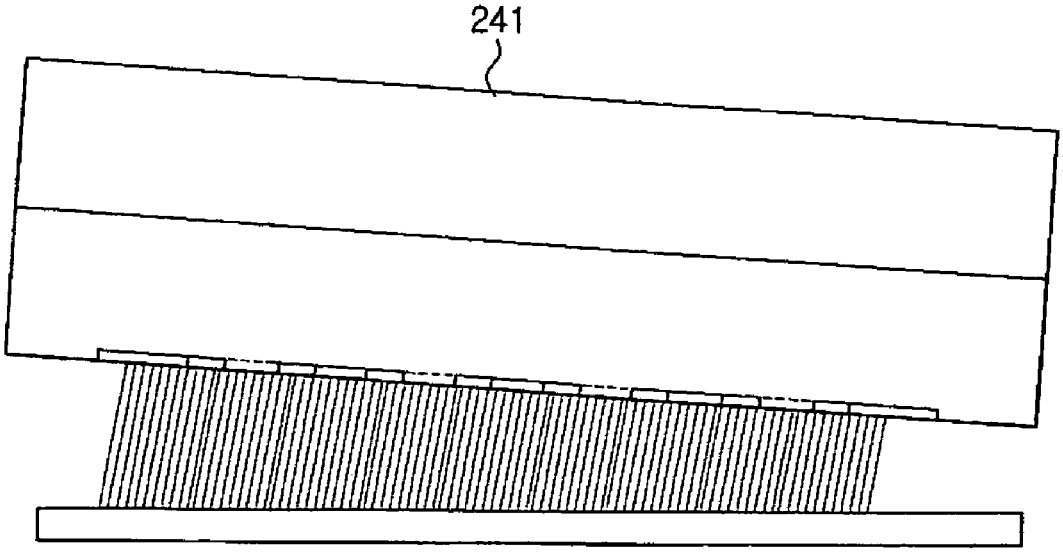
FIG. 10 is a front view illustrating an ink ejection device according to another embodiment of the present general inventive concept.

FIG. 10 illustrates an ink ejection device according to another embodiment of the present general inventive concept. As illustrated in FIG. 10, a print head 241 is mounted at a predetermined angle inclined with respect to a surface of a printing medium P in the ink ejection device. The print head 241 may be inclined at the predetermined angle in a printing line direction of the printing medium P.

Figure 11:
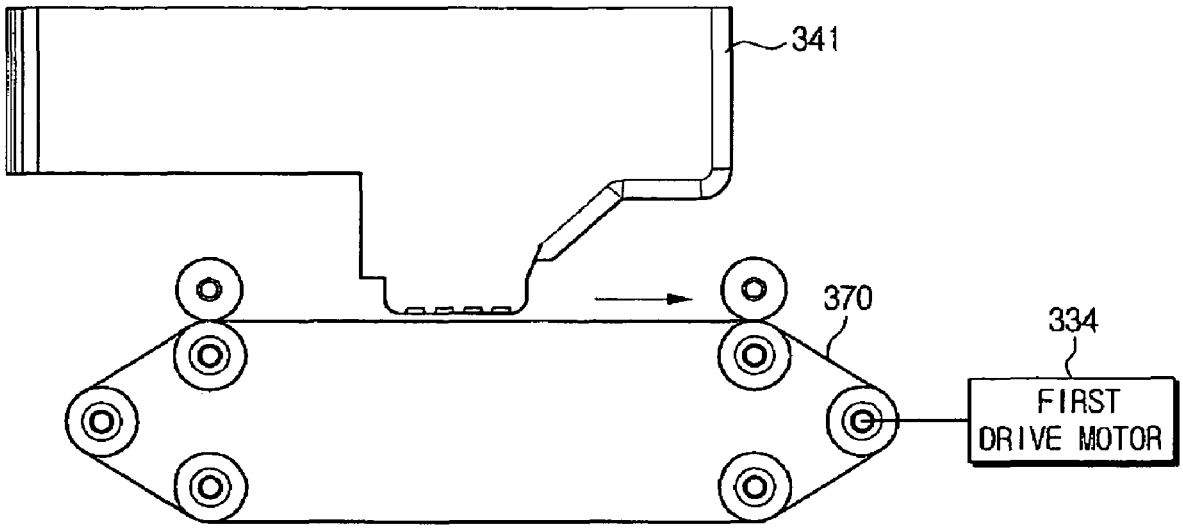
FIG. 11 is a front view illustrating an ink ejection device according to another embodiment of the present general inventive concept.

FIG. 11 illustrates an image forming apparatus according to another embodiment of the present general inventive concept. As illustrated in FIG. 11, the image forming apparatus conveys a printing medium P differently from the image forming apparatus of the embodiment of FIG. 2. The image forming apparatus illustrated in FIG. 11 includes a convey belt 370 with an endless track to covey the printing medium P. When the number of total gap controlling times N is determined, the controller 50 (see FIG. 3) drives a first drive motor 334 to rotate the convey belt 370 as many times as the number of total gap controlling times N.

As described above, an image forming apparatus according to various embodiments of the present general inventive concept form images while controlling a gap size between a print head and a printing medium. Therefore, the image forming apparatus according to the various embodiments of the present general inventive concept can form the images with a narrower pixel gap than a gap of nozzles in the print head. As a result, the images can be formed with a higher printing resolution than a nozzle printing resolution.

Also, a number of nozzles in a head chip can be reduced, since the image forming apparatus does not require an improved nozzle printing resolution to increase the printing resolution. Accordingly, a yield of the head chip is also increased.

Furthermore, image quality can be improved and a life cycle of the print head can be extended since the image forming apparatus according to the various embodiments of the present general inventive concept can correct image distortion, which is caused by malfunctioning nozzles, by controlling the gap size between the print head and the printing medium.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink ejection device comprising:

a print head including at least one head chip in which a plurality of nozzles are arranged to eject ink on a printing medium at a predetermined angle inclined with respect to a printing line extending along a widthwise direction of the printing medium; and a gap controlling unit to control a gap size between the printing medium and the plurality of nozzles by determining whether one or more of the plurality of nozzles is malfunctioning, and by determining a number of first gap controlling times according to a target printing resolution and a first gap size that corresponds to each of the determined number of first gap controlling times when none of the nozzles is determined to be malfunctioning.

2. The ink ejection device of claim 1, wherein the gap controlling unit includes:

a cam member to change a location of the print head; and a drive motor to drive the cam member.

3. The ink ejection device of claim 1, wherein an ink ejection passage of the plurality of nozzles is inclined with respect to the printing line of the printing medium at the predetermined angle.

4. The ink ejection device of claim 1, wherein the at least one head chip is disposed in the print head at the predetermined angle inclined with respect to the printing line of the printing medium.

5. The ink ejection device of claim 1, wherein the print head is mounted at the predetermined angle inclined with respect to the printing line of the printing medium.

6. An image forming apparatus, comprising:

a print head including at least one head chip in which a plurality of nozzles is arranged to eject ink on a printing medium at a predetermined angle inclined with respect to a printing line extending along a widthwise direction of the printing medium;

a conveying unit to convey the printing medium to a location where the print head forms an image on the printing medium;

a gap controlling unit to control a gap size between the printing medium and the plurality of nozzles; and a controller to control the gap controlling unit to control the gap size and to control the print head to eject ink, wherein the controller determines whether one or more of the plurality of nozzles is malfunctioning, determines a number of first gap controlling times according to a target printing resolution, determines a first gap size according to the determined number of first gap controlling times when none of the nozzles is determined to be malfunctioning, and controls the first gap size that corresponds to each of the first gap controlling times by controlling the gap controlling unit.

7. The image forming apparatus of claim 6, wherein the conveying unit includes:

a feed roller to be rotated while contacting to the printing medium; and a first drive motor to drive the feed roller.

8. The image forming apparatus of claim 7, wherein:

the gap controlling unit includes:

a cam member to change a location of the print head, and a second drive motor to drive the cam member; and the controller controls the second drive motor to control the gap size.

9. The image forming apparatus of claim 8, wherein the controller drives the first drive motor with a constant speed, and controls the gap size as many times as a total number of gap controlling times at every printing period by controlling the second drive motor.

10. The image forming apparatus of claim 8, wherein the controller repeatedly drives the first drive motor in a forward direction and a backward direction to convey the printing medium to a location where the print head forms images corresponding to a number of gap controlling times.

11. The image forming apparatus of claim 7, wherein the conveying unit includes:

a convey belt rotated in a manner to have an endless track; and a first drive motor to drive the convey belt, and the controller rotates the convey belt to convey the printing medium to a location where the print head forms images corresponding to a number of gap controlling times by controlling the first drive motor.

12. An image forming apparatus, comprising:

a print head including at least one head chip in which a plurality of nozzles is arranged to eject ink on a printing medium at a predetermined angle inclined with respect to a printing line extending along a widthwise direction of the printing medium;

a conveying unit to convey the printing medium to a location where the print head forms an image on the printing medium;

a gap controlling unit to control a gap size between the printing medium and the plurality of nozzles; and a controller to control the gap controlling unit to control the gap size and to control the print head to eject ink, wherein the controller determines a number of first gap controlling times according to a target printing resolution, determines a first gap size according to the determined number of first gap controlling times, and controls the first gap size that corresponds to each of the first gap controlling times by controlling the gap controlling unit, and wherein the controller determines a number of second gap controlling times to correct for a malfunctioning nozzle when one of the plurality of nozzles malfunctions, determines a second gap size that corresponds to the determined number of second gap controlling times, and controls the gap controlling unit to control the second gap size that corresponds to each of the second gap controlling times.

13. A method of forming an image usable with an image forming apparatus having a print head in which a plurality of nozzles is included to eject ink at a predetermined angle with respect to a printing line extending along a widthwise direction of a printing medium, the method comprising:

determining a number of gap controlling times to control a gap size between the plurality of nozzles and the printing medium, the determining of the number of gap controlling times comprises:

determining whether one or more of the plurality of nozzles is malfunctioning; and determining a number of first gap controlling times according to a target printing resolution and a first gap size that corresponds to each of the determined number of first gap controlling times when none of the nozzles is determined to be malfunctioning; and determining a gap size for each of the gap controlling times; and ejecting ink a number of times equal to the number of gap controlling times while controlling the gap size that corresponds to the number of gap controlling times at each corresponding printing period, wherein the ejecting of the ink comprises ejecting drops of ink by controlling the gap size a number of times that is equal to the number of gap controlling times at each corresponding printing period while conveying the printing medium with a constant speed.

14. The method of claim 13, wherein the gap size is controlled by changing at least one of a location of the print head and a location of a medium supporting member to support the printing medium.

15. The method of claim 13, wherein the ejecting of the ink comprises ejecting drops of ink by controlling the gap size that corresponds to the number of gap controlling times while rotating the printing medium on an endless track a number of times that is equal to the determined number of gap controlling times.

16. A method of forming an image usable with an image forming apparatus having a print head in which a plurality of nozzles is included to eject ink at a predetermined angle with respect to a printing line extending along a widthwise direction of a printing medium, the method comprising:

determining a number of gap controlling times to control a gap size between the plurality of nozzles and the printing medium, wherein the determining of the number of gap controlling times comprises:

determining whether one or more of the plurality of nozzles is malfunctioning; and determining a number of first gap controlling times according to a target printing resolution and a first gap size that corresponds to each of the determined number of first gap controlling times when none of the nozzles is determined to be malfunctioning; and determining a gap size for each of the gap controlling times; and ejecting ink a number of times equal to the number of gap controlling times while controlling the gap size that corresponds to the number of gap controlling times at each corresponding printing period.

17. The method of claim 16, wherein the determining of the number of gap controlling times further comprises:

determining the number of first gap controlling times according to the target resolution and a number of second gap controlling times to correct image distortion caused by the one or more malfunctioning nozzles; and determining the first gap size for the number of first gap controlling times according to the target printing resolution and a second gap size that corresponds to the number of second gap controlling times according to the one or more malfunctioning nozzles.

18. A method of forming an image usable with an image forming apparatus having a print head in which a plurality of nozzles is included to eject ink at a predetermined angle with respect to a printing line extending along a widthwise direction of a printing medium, the method comprising:

determining a number of gap controlling times to control a gap size between the plurality of nozzles and the printing medium, and determining a gap size for each of the gap controlling times; and ejecting ink a number of times equal to the number of gap controlling times while controlling the gap size that corresponds to the number of gap controlling times at each corresponding printing period, wherein the ejecting of the ink comprises:

ejecting a first one or more drops of ink on the printing medium while conveying the printing medium in a forward direction;

controlling the gap size; and ejecting a second one or more drops of ink on the printing medium while conveying the printing medium in a backward direction.

* * * * *